US007090373B2

(12) United States Patent
Lai

(10) Patent No.: US 7,090,373 B2
(45) Date of Patent: Aug. 15, 2006

(54) FLASHLIGHT WITH SUPPORTING STRUCTURE

(75) Inventor: Larry Lai, Tai Bao (TW)

(73) Assignee: Plum Industrial Co., Ltd. (TW)

( * ) Notice: Subject to any disclaimer, the term of this patent is extended or adjusted under 35 U.S.C. 154(b) by 35 days.

(21) Appl. No.: 11/012,356

(22) Filed: Dec. 16, 2004

(65) Prior Publication Data

US 2006/0133074 A1 Jun. 22, 2006

(51) Int. Cl.
*F21L 4/04* (2006.01)

(52) U.S. Cl. ..... 362/202; 362/190; 362/205; 362/414; 362/418

(58) Field of Classification Search ..... 362/202, 362/190, 205, 208, 395, 413, 414, 418
See application file for complete search history.

(56) References Cited

U.S. PATENT DOCUMENTS 1,926,377 A * 9/1933 Floraday ..... 362/190
5,595,436 A * 1/1997 Way et al. ..... 362/190
5,746,495 A * 5/1998 Klamm ..... 362/577
6,099,141 A * 8/2000 Landamia ..... 362/184

* cited by examiner

*Primary Examiner*—Sandra O'Shea
*Assistant Examiner*—Sharon Payne
(74) *Attorney, Agent, or Firm*—Stites & Harbison PLLC; Marvin Petry

(57) ABSTRACT

A flashlight includes a barrel, a connecting member, a seat, and an end cap. The connecting member is mounted to a bottom end of the barrel and allows the barrel to move to a desired angle relative to the connecting member. The seat includes a larger chamber, and two smaller chambers. A front leg is slidably mounted in the larger chamber and movable between a retracted position in the larger chamber and an extended position outside the larger chamber. A side leg is mounted in each smaller chamber and pivotable between a retracted position in an associated smaller chamber and an extended position outside the associated smaller chamber.

4 Claims, 4 Drawing Sheets

FLASHLIGHT WITH SUPPORTING STRUCTURE

BACKGROUND OF THE INVENTION

1. Field of the Invention

The present invention relates to a flashlight. In particular, the present invention relates to a flashlight with a supporting structure.

2. Description of the Related Art

A bottom end of a flashlight, when placed upright, is placed on a flat surface. However, the flashlight is apt to fall. Further, it is impossible to place the flashlight in a tilted state.

SUMMARY OF THE INVENTION

An objective of the present invention is to provide a flashlight that can be placed upright in a stable manner.

Another object of the present invention is to provide a flashlight allowing adjustment in tilt angle.

A flashlight in accordance with the present invention comprises a barrel, a connecting member, a seat, and an end cap. The barrel includes a bottom end with a convex wall. A guide block is formed on a center of the convex wall and has an inner threading. At least one light is mounted on the barrel and at least one switch is mounted on the barrel for controlling on/off of the light.

The connecting member is mounted to the bottom end of the barrel and includes a concave wall has a shape complementary to the convex wall of the barrel. The concave wall includes a slot through which the guide block extends, allowing the barrel to move to a desired angle relative to the connecting member. A fastener is threadedly engaged with the inner threading of the guide block and includes a head. The connecting member further includes a plurality of pegs extending downward from a periphery of an inner wall face of the convex wall, each peg having a screw hole.

The seat includes two screw holes, a larger chamber, and two smaller chambers. A protrusion is formed on each of a front end and a rear end of each of two lateral walls delimiting the larger chamber. The end cap includes two screw holes and covers a bottom end of the larger chamber and a bottom end of each smaller chamber.

Two screws respectively extend through the screw holes in the end cap and the screw holes in the seat into the screw holes of the pegs, thereby fixing the end cap, the seat, and the connecting member together.

A front leg is slidably mounted in the larger chamber and movable between a retracted position in the larger chamber and an extended position outside the larger chamber. The front leg includes two engaging portions respectively on inner ends of two lateral sides thereof for selectively engaging with the protrusions of the larger chamber, thereby selectively retaining the front leg in one of the retracted position in the larger chamber and the extended position outside the larger chamber.

Two side legs are respectively received in the smaller chambers. Each side leg has an end through which an associated one of the screws extends, thereby allowing pivotal movement of each side leg. Each side leg is pivotable between a retracted position in an associated one of the smaller chambers and an extended position outside the associated smaller chamber.

The front leg may further include an extension leg slidably mounted thereto. The extension leg includes an elongated slot. The front leg includes a hole. A stop extends into the elongated slot of the extension leg, and a screw is extended through the stop, the hole of the front leg, and the elongated slot of the extension leg, thereby limiting extension and retraction of the extension leg.

A dustproof sleeve may be mounted around the barrel for covering the connecting seat. The barrel includes an annular groove in an outer periphery thereof, and the dustproof sleeve includes a reduced section for engaging with the annular groove of the barrel.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
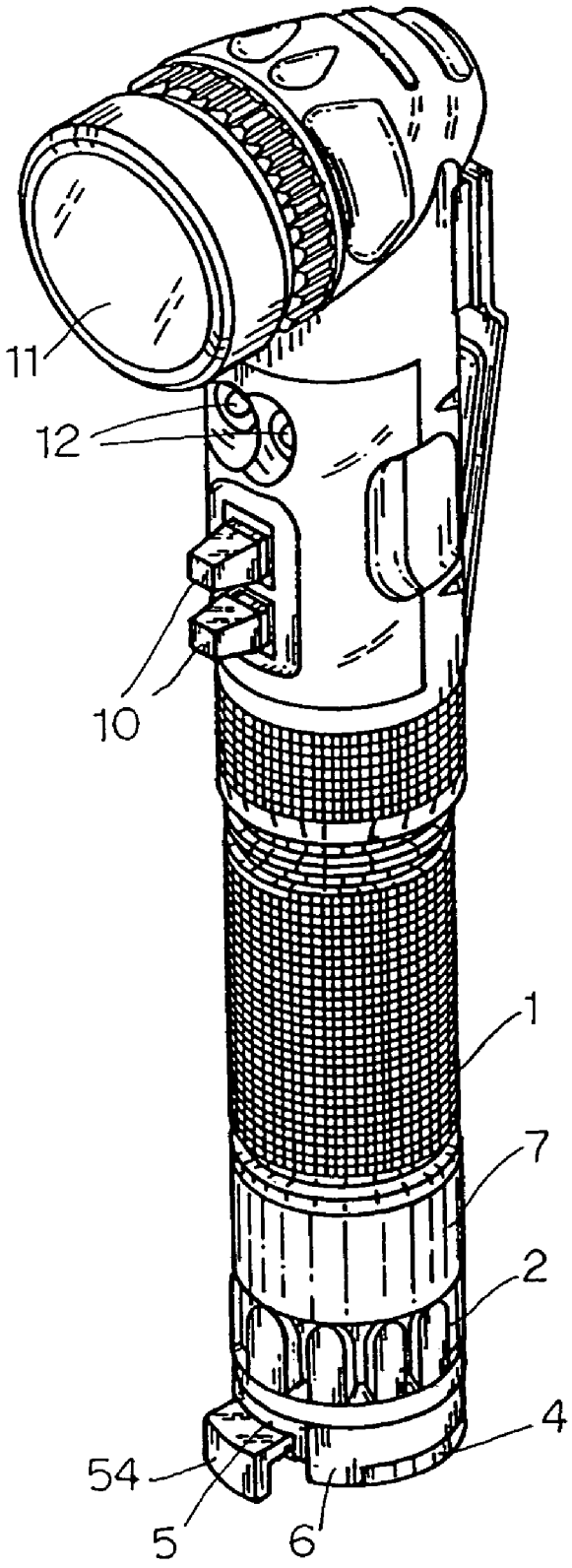
FIG. 1 is a perspective view of a flashlight in accordance with the present invention.

Referring to FIGS. 1, 2, 3, and 6, a flashlight in accordance with the present invention comprises a barrel 1, a connecting member 2, a seat 3, an end cap 4, and a supporting structure including a front leg 5 and two side legs 6. At least one battery (not shown) is received in the barrel 1. Switches 10 are mounted on the barrel 1 for controlling on/off of a headlight 11 and two smaller lights 12. The barrel 1 further includes a convex wall 13 at a bottom end thereof, with a guide block 14 being formed on a center of the convex wall 13 and having an inner threading 141.

The connecting member 2 includes a closed upper end and an open lower end. The upper end of the connecting member 2 includes a concave wall 21 having a shape complementary to the convex wall 13. The concave wall 21 includes a slot 22 through which the guide block 14 extends. Thus, the guide block 14 is movable along the slot 22. In other words, the barrel 1 is movable to a desired tilt angle with respect to the connecting member 2. Preferably, the guide block 14 has a width slightly smaller than that of the slot 22. To retain the tilt angle of the barrel 1, a fastener 24 having a head 241 is threadedly engaged with the inner threading 141 of the guide block 14. Further, a plurality of pegs 23 extend downward from a periphery of an inner wall face of the convex wall 21. Each peg 23 has a screw hole (not labeled)

The seat 3 includes a plurality of rear screw holes 31, a plurality of front screw holes 32, a plurality of engaging holes 33, a larger front chamber 34, and two smaller chambers 36. Screws 35 are extended through the screw holes 31 and 32 of the seat 3 into the screw holes of the pegs 23 of the connecting member 2. Thus, the seat 3 is fixed to the connecting member 2. A protrusion 342 is formed on each of a front end and a rear end of each of two lateral walls 341 delimiting the larger chamber 34. The smaller chambers 36 are located on two sides of the larger chamber 34.

The end cap 4 includes a plurality of rear screw holes 41, a plurality of front screw holes 42, and a plurality of engaging studs 43. The screws 35 are extended through the screw holes 41 and 42 of the end cap 4, the screw holes 31 and 32 of the seat 3 into the screw holes of the pegs 23 of the connecting member 2. Thus, the end cap 4, the seat 3, and the connecting member 2 are fixed together, with the end cap 4 covering bottom ends of the larger chamber 34 and the smaller chambers 36. The engaging studs 43 of the end cap 4 are engaged with the engaging holes 33 of the seat 3.

The front leg 5 has a shape substantially the same as that of the larger chamber 34. The front leg 5 includes two engaging portions 51 respectively on inner ends of two lateral sides thereof for selectively engaging with the protrusions 342 of the larger chamber 34, thereby selectively retaining the front leg 5 in one of a retracted position in the larger chamber 34 and an extended position outside the larger chamber 34. To increase the overall length of the front leg 5, an extension leg 54 is slidably received in the front leg 5. A screw 53 is extended through a stop 52, a hole 55 in the front leg 5, and an elongated slot 541 of the extension leg 54. Thus, the extension and retraction of the extension leg 54 is limited by the stop 52 that extends into the elongated slot 541 of the extension leg 54.

Each side leg 6 includes a pivotal portion 60 with a through-hole 61. The pivotal portion 60 is located in an associated smaller chamber 36. An associated one of the screws 35 is extended through the through-hole 61 of the pivotal portion 60, an associated rear screw hole 31, and an associated rear screw hole 41. Thus, each side leg 6 is pivotable about the associated screw 35.

Figure 2:
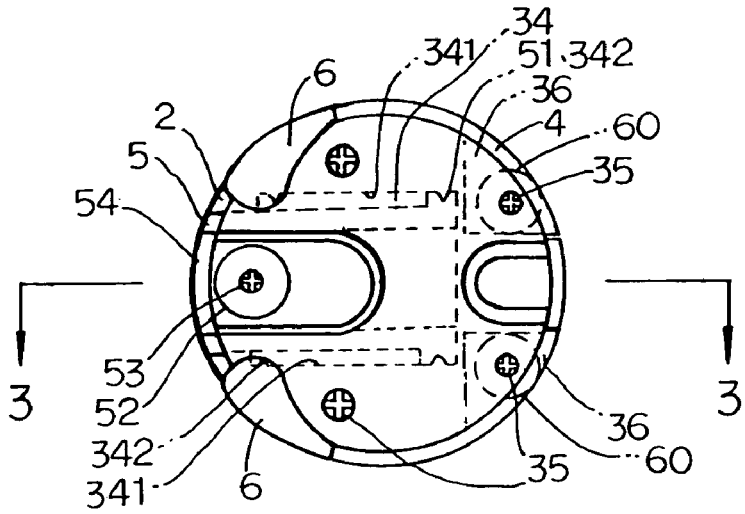
FIG. 2 is a bottom view of the flashlight in accordance with the present invention.
Figure 3:
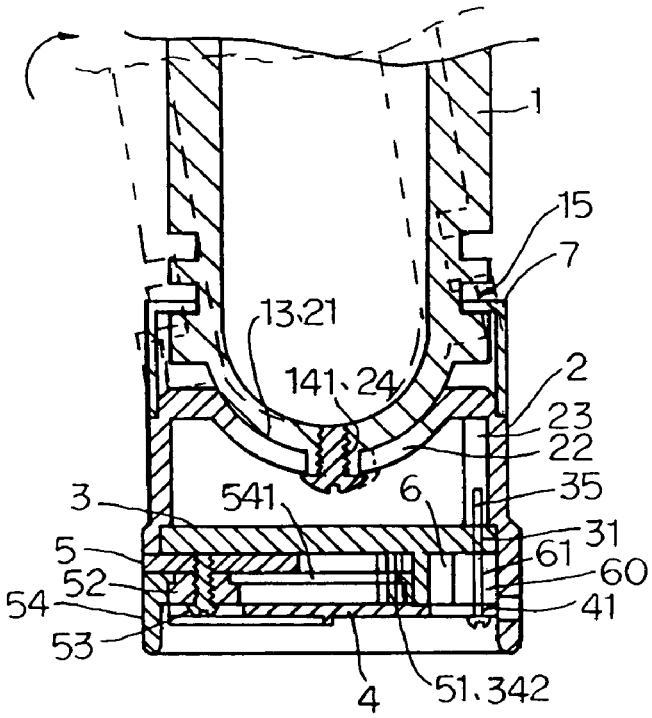
FIG. 3 is a sectional view taken along plane 3—3 in FIG. 2.
Figure 4:
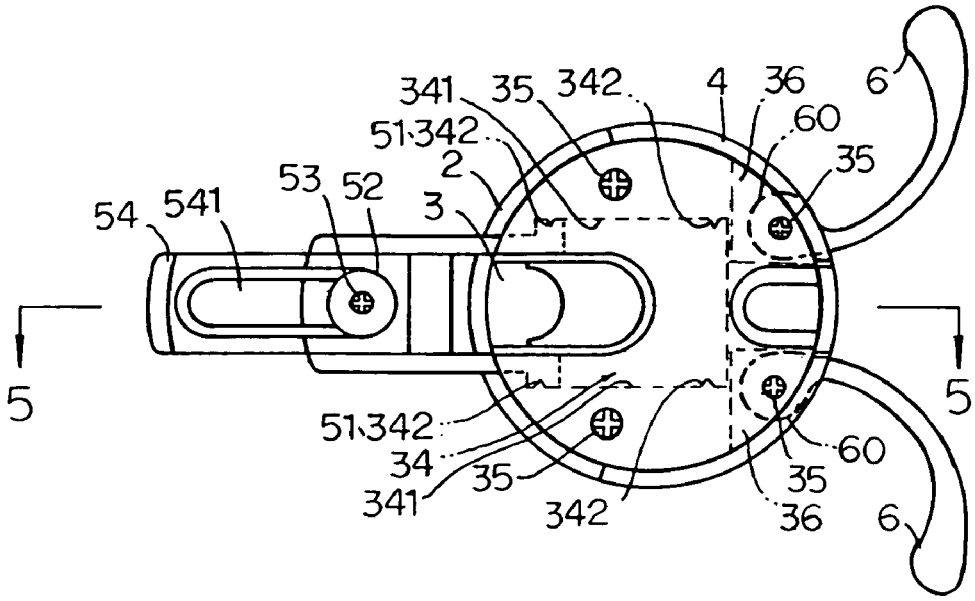
FIG. 4 is a view similar to FIG. 2, illustrating use of a supporting structure of the flashlight.
Figure 5:
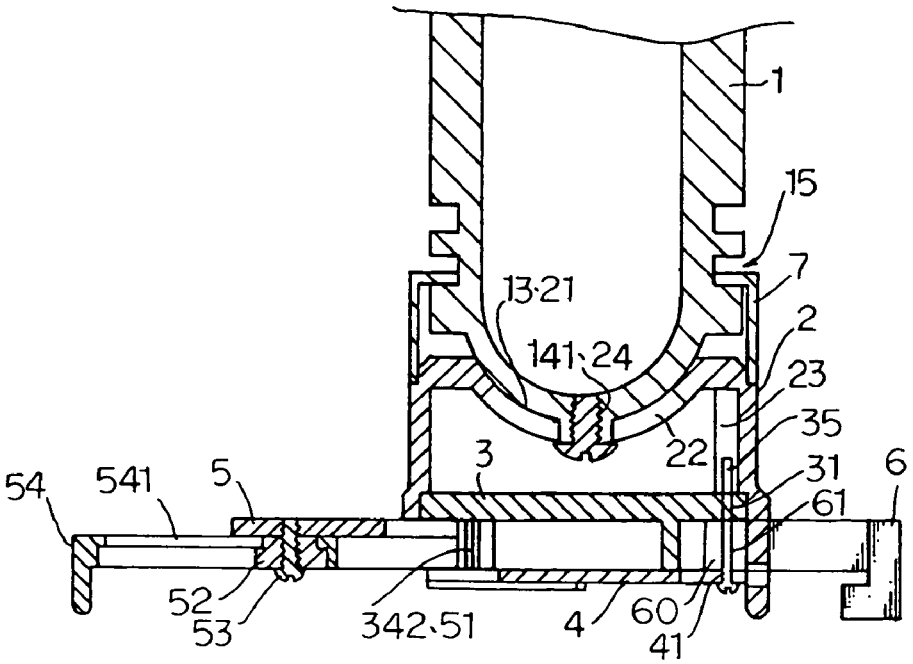
FIG. 5 is a sectional view taken along plane 5—5 in FIG. 4.
Figure 6:
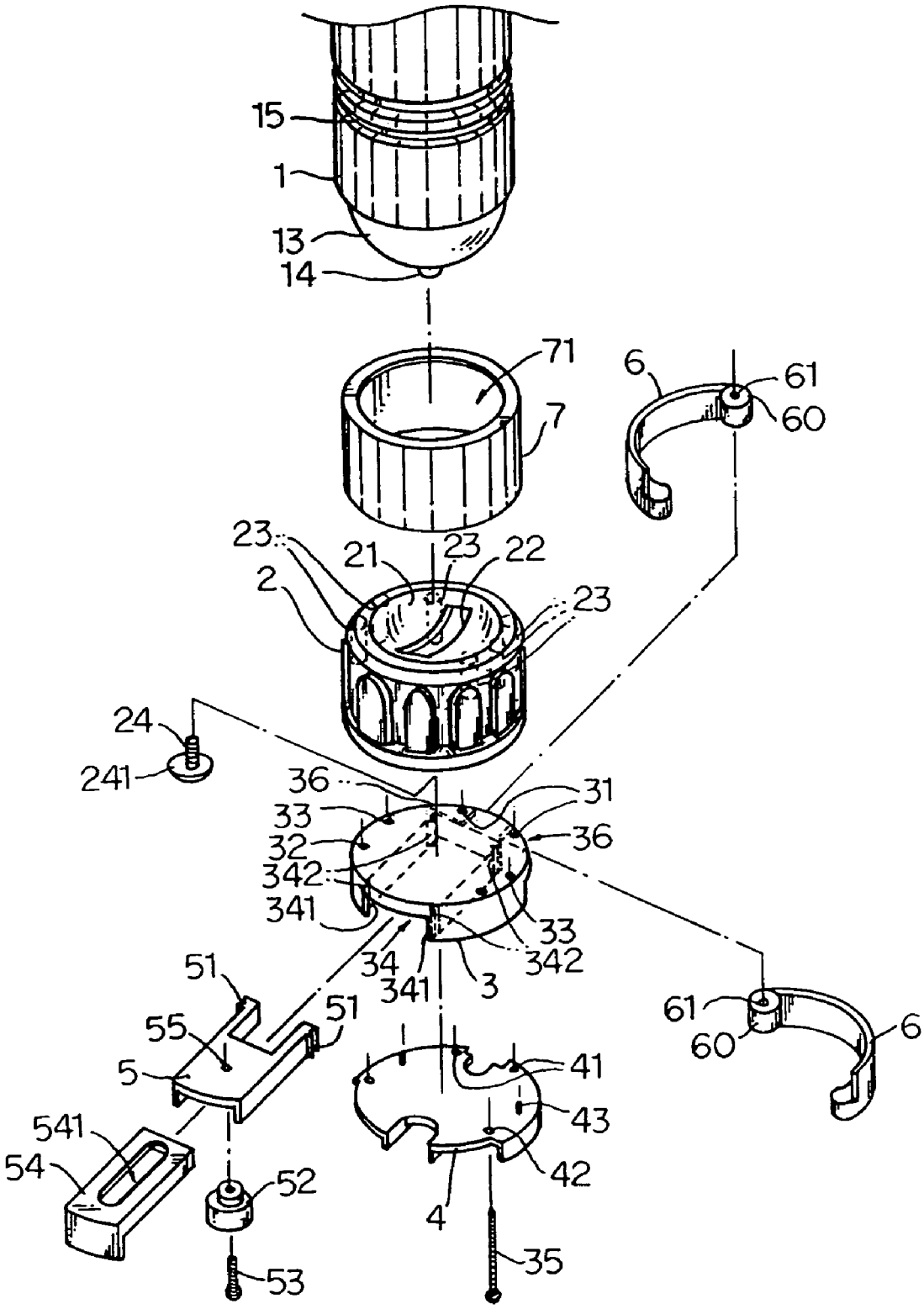
FIG. 6 is an exploded perspective view of the flashlight in accordance with the present invention.

Each side leg 6 is received in an associated smaller chamber 36 when not in use, as shown in FIGS. 2 and 3. Referring to FIGS. 4 and 5, when the flashlight is placed upright, to provide a stable support, the front leg 5 and the extension leg 54 are pulled outward, and the side legs 6 are pivoted outward. The front leg 5, the extension leg 54, and the side legs 6 are moved to their retracted positions when not in use. Operation of the supporting structure is simple.

A dustproof sleeve 7 may be mounted around the barrel 1 to shield the connecting member 2, preventing alien objects and/or dust from entering the slot 22 of the connecting member 2. The dustproof sleeve 7 is made of soft material such as rubber. The dustproof sleeve 7 includes a reduced section for engaging with an annular groove 15 in an outer periphery of the barrel 1.

Although a specific embodiment has been illustrated and described, numerous modifications and variations are still possible without departing from the essence of the invention. The scope of the invention is limited by the accompanying claims.

What is claimed is:

1. A flashlight comprising:

a barrel including a bottom end with a convex wall, a guide block being formed on a center of the convex wall and having an inner threading, at least one light being mounted on the barrel, at least one switch being mounted on the barrel for controlling on/off of said at least one light;

a connecting member mounted to the bottom end of the barrel, the connecting member including a concave wall having a shape complementary to the convex wall of the barrel, the concave wall including a slot through which the guide block extends, allowing the barrel to move to a desired angle relative to the connecting member, a fastener being threadedly engaged with the inner threading of the guide block and including a head, the connecting member further including a plurality of pegs extending downward from a periphery of an inner wall face of the convex wall, each said peg having a peg screw hole;

a seat including two seat screw holes, a larger chamber, and two smaller chambers, a protrusion being formed on each of a front end and a rear end of each of two lateral walls delimiting the larger chamber;

an end cap including two end cap screw holes, the end cap covering a bottom end of the larger chamber and a bottom end of each said smaller chamber;

two screws extending through the end cap screw holes and the screw holes in the seat into the peg screw holes, thereby fixing the end cap, the seat, and the connecting member together;

a front leg slidably mounted in the larger chamber and movable between a retracted position in the larger chamber and an extended position outside the larger chamber, the front leg including two engaging portions respectively on inner ends of two lateral sides thereof for selectively engaging with the protrusions of the larger chamber, thereby selectively retaining the front leg in one of the retracted position in the larger chamber and the extended position outside the larger chamber; and two side legs respectively received in the smaller chambers, each said side leg having an end through which an associated one of the screws extends, thereby allowing pivotal movement of each said side leg, each said side leg being pivotable between a retracted position in an associated one of the smaller chambers and an extended position outside the associated smaller chamber.

2. The flashlight as claimed in claim 1 wherein the front leg further includes an extension leg slidably mounted thereto, the extension leg including an elongated slot, the front leg including a hole, a stop extending into the elongated slot of the extension leg, a screw being extended through the stop, the hole of the front leg, and the elongated slot of the extension leg, thereby limiting extension and retraction of the extension leg.

3. The flashlight as claimed in claim 1 further comprising a dustproof sleeve mounted around the barrel for covering the connecting seat, the barrel including an annular groove in an outer periphery thereof, the dustproof sleeve including a reduced section for engaging with the annular groove of the barrel.

4. The flashlight as claimed in claim 2 further comprising a dustproof sleeve mounted around the barrel for covering the connecting seat, the barrel including an annular groove in an outer periphery thereof, the dustproof sleeve including a reduced section for engaging with the annular groove of the barrel.

* * * * *